United States Patent [19]

Gibson

[11] Patent Number: 4,934,058

[45] Date of Patent: Jun. 19, 1990

[54] STONE SCRIBE

[76] Inventor: Daniel E. Gibson, Rt 2 Box 310-22, Santa Fe, N. Mex. 87505

[21] Appl. No.: 282,690

[22] Filed: Dec. 12, 1988

[51] Int. Cl.[5] ..... B43L 13/02

[52] U.S. Cl. ..... 33/42; 33/DIG. 20

[58] Field of Search ..... 33/42, 24.3, 41.1, 41.5, 33/526, 527, DIG. 20

[56] References Cited

U.S. PATENT DOCUMENTS

| | | | |
|---|---|---|---|
| 637,923 | 11/1899 | Chase | 33/24.3 |
| 915,219 | 3/1909 | Regelson | 33/42 |
| 1,276,261 | 8/1918 | Peterson | 33/41.5 |
| 1,662,165 | 3/1928 | Punt | 33/41.5 |
| 2,409,106 | 10/1946 | Connelly | 33/41.5 |
| 3,918,162 | 11/1975 | Houle | 33/243 X |

*Primary Examiner*—Harry N. Haroian

[57] ABSTRACT

Stone Scribe is such that enables the skilled stone mason (specifically one who lays flagstone) to do accurate and precise markings when cutting the stones to fit with tight joints. The Stone Scribe is an uncomplicated set of metal bars set up to be sturdy enough to actually trace the edge of one stone on to another. This tool enables the worker to do professional jobs, minimizing the time spent.

1 Claim, 1 Drawing Sheet

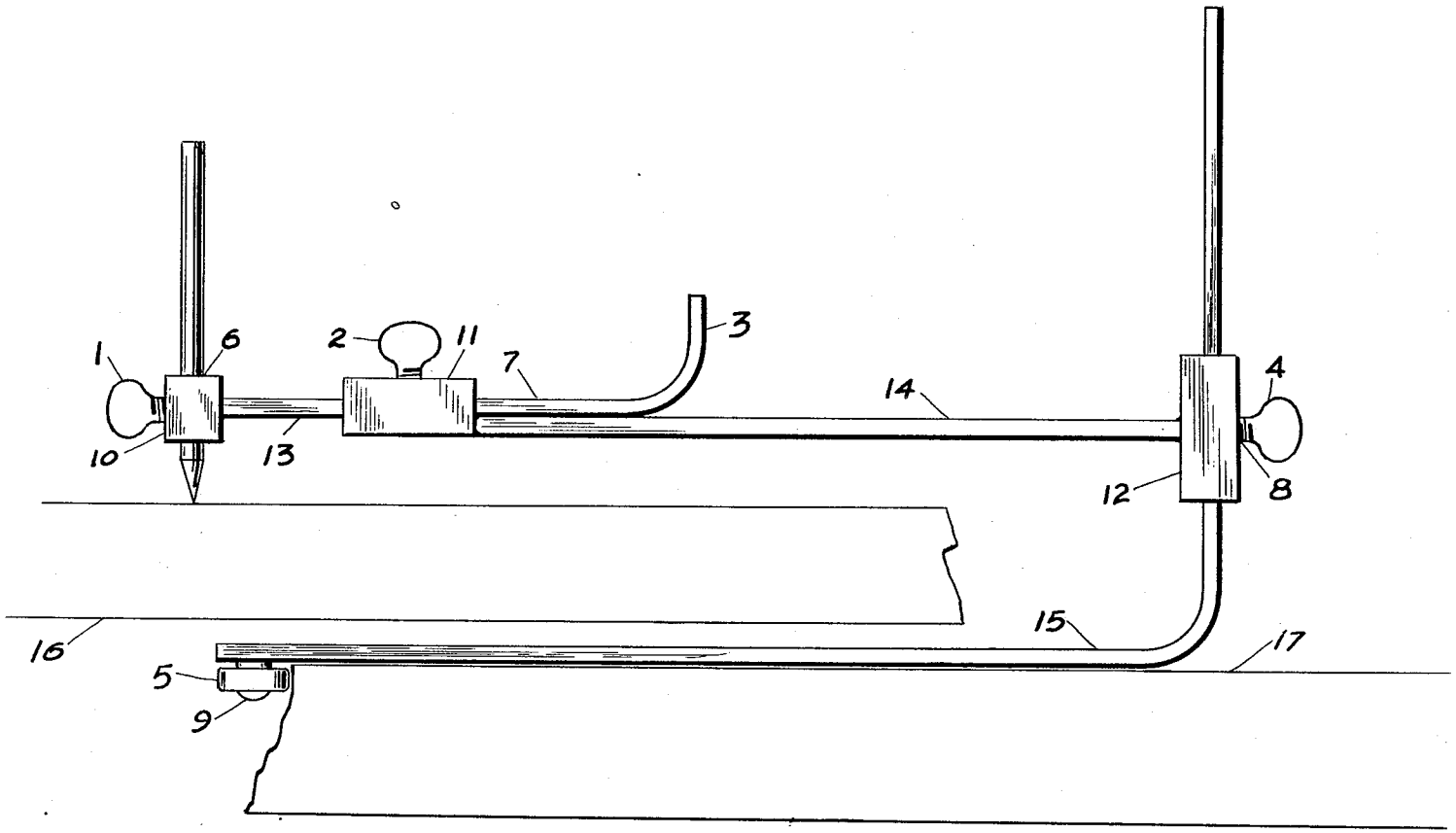
4
8
17
12
15
14
3
7
11
2
13
6
1
10
5
9
16

STONE SCRIBE

BACKGROUND OF THE INVENTION

1. Field of the Invention

The invention relates generally to the field of flagstone. The major work done in flagstone are patios, swimming pools, walkways and other similar jobs. Much flagstone work is done cheaply and unprofessionally, with little or no cutting of the stone and large sloppy joints. The professional worker comprises the field concerned with here.

2. Description of the Prior Art

Previous methods of creating a flagstone area with equal jointing involved a time consuming, inaccurate method using measurements, eye judgments and a retractable rule to duplicate angles. To fit one stone against another, the side of the stone to be layed against is measured and correspondingly marked on the stone to be cut. The line for cutting therefore, has to depend on eye judgment and guessing. A completed work using this previous method is pleasing to the eye, however, using the Stone Scribe, the work is not only pleasing, it is more accurate, involves no guessing and saves the worker an enormous amount of time and frustration. Also in creating tight joints, it provides a practical fuction. The tight joints are less likely to crack and break out and therefore, increases the longevity of the flagstone area.

SUMMARY OF THE INVENTION

The invention relates to a device invented for the purpose of creating professional work with tight jointing, more mosiac patterns, and minimal time expenditure. The Stone Scribe consists of three metal bars, two of which are adjustable. The first adjustable member holds a marking device, the second adjustable member adjusts to the thickness of stone, and the third member holds the disc roller which runs along the stone edge, causing the marking device to trace the exact line of the stone to be laid against. The three bars work together as one unit and is extremely easy to both utilize and manufacture.

BRIEF DESCRIPTION OF THE DRAWINGS

FIG. 1 is a side view of the invention.

Sec A is an adjustable member which holds the marking device.

Sec B is the member comprising both adjustments, one which adjusts to the thickness of stone, the other which allows the marking device member to adjust.

Sec C is the stabilizing member which contains the disc roller tracer.

DESCRIPTION OF THE PREFERRED EMBODIMENT

In reference to the drawing of the Stone Scribe, there are three sections. The first section, Sec. A, functions as the holder for the marking device, and the guide for joint width. The pencil, fitting through a hole, 6, is held in place by a threaded stud, 1, coming through a threaded opening, 10, and pressing against the side of the pencil to hold it vertical. Sec. A is adjustable by slidably mounting upon the second section, Sec. B, through a slot, 7. In the FIG. 1, the slot is a constructed box going around both sections and welded to Sec. B. Sec. A is then also held in place by a threaded stud, 2, going through a threaded opening, 11, and pressing against the top of Sec. A. The adjustments could be constructed by any functioning method. Here the adjustment stops at the L-shape catch, 3.

Sec. B functions by holding Sec. A parallel to the tracer, 5, and also comprises both adjusting attachments, 7 and 12. It is adjustable, remaining horizontal, according to the thickness of stone to be cut. This adjustment is another welded box, 12, welded to the end which slides on the vertical portion of the third section, Sec. C, and is held in place by a threaded stud, 4, coming through a threaded opening, 8, and resting on the side of Sec. C, to secure it.

Sec. C then is the stabilizer of the unit. It does not adjust and attaches by screw, 9, the disc roller bearing, 5, which acts as a tracer along the edge of the stone to be layed against. In usage, Sec. C sits below the other two sections causing them to be parallel and horizontal, while the pencil is vertical.

The Stone Scribe is easily constructed and does not ha have to comply with any strict patterns or directions. It is important for all three members to work together as one unit. Another adjustment could have been added to enable the device to slide longer or shorter, or it could be constructed as a telescoping or collapsable tool, however it could hinder the working ease of the tool and having two sizes of the Stone Scribe would be just as practical to solve the problem. Although a detailed embodiment of the invention is illustrated and previously described, this invention contemplates any configuration and design of components; the invention can be constructed by different methods.

I claim:

1. A stone scribe device for tracing the edge of one piece of flagstone onto another which comprises; a two member instrument of strong bar-like metal, one member comprising an L-shaped member and the second comprising a substantially straight member, a disc roller tracer pivotally mounted on the end of the longer arm of the L-shaped member and the second member has an integral slot at one end to slidably receive the end of the shorter arm of the L-shaped member so that the longer arm and the second member remain in parallelism when adjusted to various positions with respect to one another, a second integrally formed slot, at the other end of said second member, a straight elongated extension piece slidably mounted through said second slot in parallelism with and in intimate contact along its length with said second member, said extension piece having a stop means on one end, and a third slot integrally formed at the other end, said third slot extending perpendicularly to said piece, said stop means preventing said extension piece from sliding through said second slot, a marking device slidably extending through said third slot for marking the surface of a flagstone and said slots having screw lock means for engaging the L-shaped member, the extension piece and the marking device to maintain the device in adjusted positions.

* * * * *